US010407914B2

(12) United States Patent
Seo

(10) Patent No.: US 10,407,914 B2
(45) Date of Patent: Sep. 10, 2019

(54) SPACER FOR PREFABRICATED SPIRAL STAIRCASE AND PREFABRICATED SPIRAL STAIRCASE USING SAME

(71) Applicant: Seonghwan Seo, Goyang-si (KR)

(72) Inventor: Seonghwan Seo, Goyang-si (KR)

( * ) Notice: Subject to any disclaimer, the term of this patent is extended or adjusted under 35 U.S.C. 154(b) by 0 days.

(21) Appl. No.: 16/071,450

(22) PCT Filed: Jan. 10, 2017

(86) PCT No.: PCT/KR2017/000297

§ 371 (c)(1),
(2) Date: Jul. 19, 2018

(87) PCT Pub. No.: WO2017/142199

PCT Pub. Date: Aug. 24, 2017

(65) Prior Publication Data

US 2019/0003186 A1 Jan. 3, 2019

(30) Foreign Application Priority Data

Feb. 15, 2016 (KR) ..... 10-2016-0017009

(51) Int. Cl.
*E04F 11/032* (2006.01)
*E04F 11/104* (2006.01)
*E04F 11/035* (2006.01)

(52) U.S. Cl.
CPC ..... *E04F 11/032* (2013.01); *E04F 11/035* (2013.01); *E04F 11/1041* (2013.01)

(58) Field of Classification Search
CPC ..... E04F 11/032; E04F 15/02464; E04F 11/1041
See application file for complete search history.

(56) References Cited

U.S. PATENT DOCUMENTS 599,441 A * 2/1898 Dorr ..... E02D 29/1409 404/26
638,692 A * 12/1899 Banwell ..... E02D 29/1409 404/26
689,224 A * 12/1901 Pillsbury ..... E02D 29/1409 404/26
814,013 A * 3/1906 Baumann ..... E02D 29/1409 404/26

(Continued)

FOREIGN PATENT DOCUMENTS

JP 06-093703 A 4/1994
JP 2000-213134 A 8/2000

(Continued)

*Primary Examiner* — Andrew J Triggs
(74) *Attorney, Agent, or Firm* — Maschoff Brennan

(57) ABSTRACT

The present invention relates to a spacer for a prefabricated spiral staircase, which allows adjustment of a height of a gap between footboards for a prefabricated spiral staircase in multiple steps by using minimal disks, and a prefabricated spiral staircase using the same. The spacer for a prefabricated spiral staircase comprises a cylindrical pipe, a lower cap or upper cap, a disk, a height adjustment member, and a location determining member, wherein the height of the spacer is adjusted in multiple stages according to relative rotation between the upper cap and the disk or between the lower cap and the disk.

2 Claims, 12 Drawing Sheets

(56) References Cited

U.S. PATENT DOCUMENTS 1,447,256 A * 3/1923 Lincoln ..... E02D 29/1409 404/26
1,673,145 A * 6/1928 Gschwind ..... E02D 29/1409 404/26
4,197,031 A * 4/1980 Hild ..... E02D 29/1409 210/163
4,906,128 A * 3/1990 Trudel ..... E02D 29/1409 404/25
5,083,714 A * 1/1992 Vendelin ..... B02C 13/286 241/275
5,211,504 A * 5/1993 Trudel ..... E02D 29/1409 404/26
5,303,583 A * 4/1994 Harris ..... E03B 7/072 73/201
5,360,131 A * 11/1994 Phillipps ..... E02D 29/1409 220/3.7
6,520,713 B2 * 2/2003 Sondrup ..... E02D 29/1409 404/26
6,524,026 B2 * 2/2003 Sondrup ..... E02D 29/1409 404/26
7,867,356 B2 * 1/2011 Tong ..... H01J 37/32623 118/724
8,382,392 B2 * 2/2013 Liao ..... E02D 29/1409 404/26
8,540,454 B2 * 9/2013 Lee ..... E02D 29/14 404/26
8,829,194 B2 9/2014 Sutton et al.
9,101,214 B2 * 8/2015 Rothschild ..... A47B 91/02
10,161,100 B2 * 12/2018 Koop ..... E02D 29/1445
2002/0136604 A1 * 9/2002 Sondrup ..... E02D 29/1409 404/26
2002/0136605 A1 * 9/2002 Sondrup ..... E02D 29/1409 404/26
2003/0235467 A1 * 12/2003 Gamson ..... E02D 29/1409 404/26
2005/0032469 A1 * 2/2005 Duescher ..... B24D 11/001 451/548
2008/0236066 A1 * 10/2008 Arnold ..... E04F 11/032 52/187
2017/0342719 A1 * 11/2017 Seo ..... E04F 11/032
2019/0003186 A1 * 1/2019 Seo ..... E04F 11/032

FOREIGN PATENT DOCUMENTS

JP 2005-220656 A 8/2005
KR 10-2004-0101161 A 12/2004
KR 10-2008-0108162 A 12/2008
KR 10-1560676 B1 10/2015

* cited by examiner

[FIG. 1]
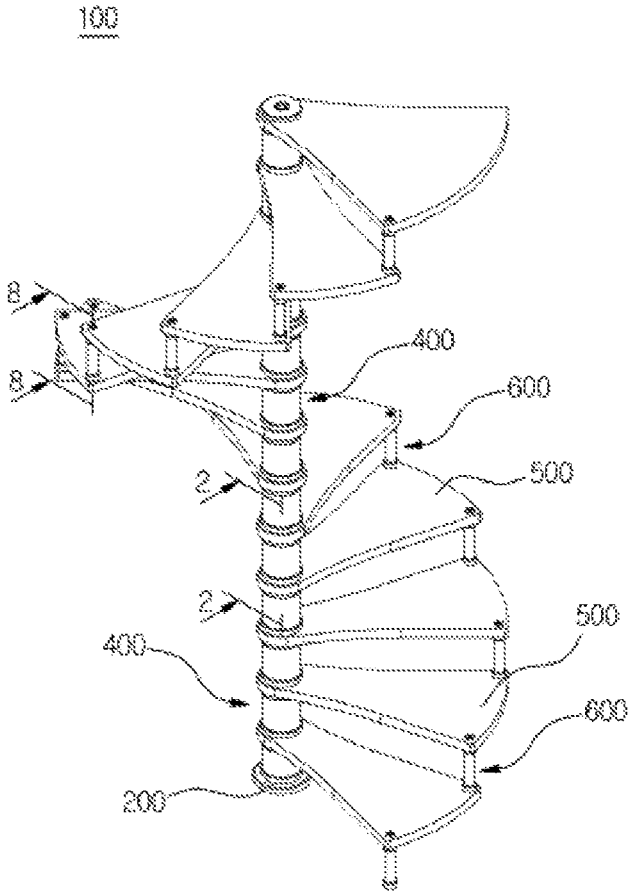

[FIG. 2]
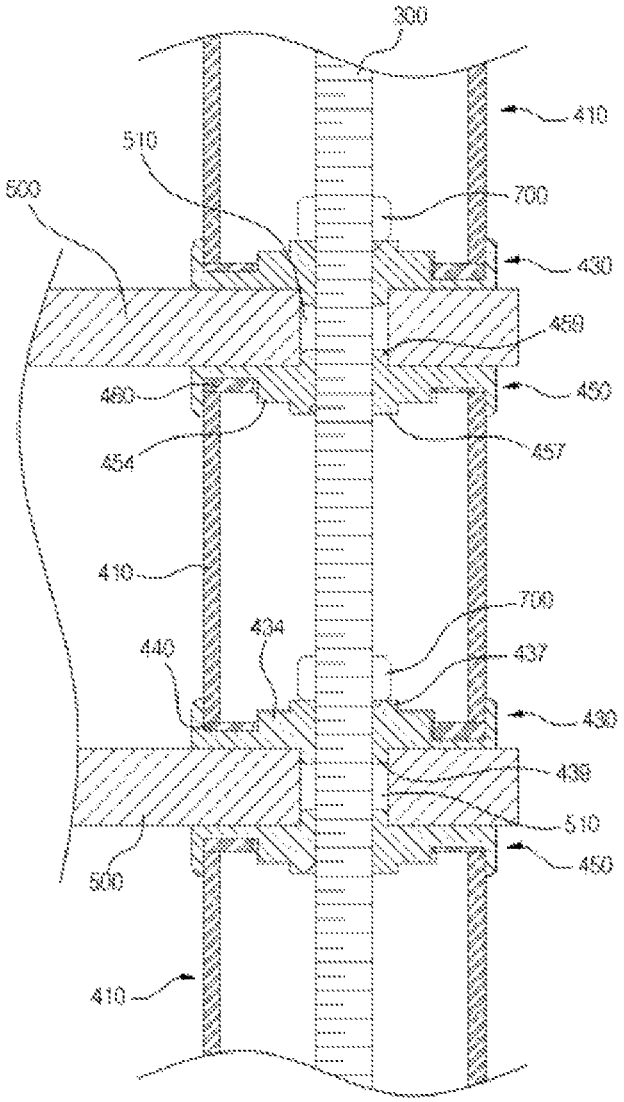

[FIG. 3]
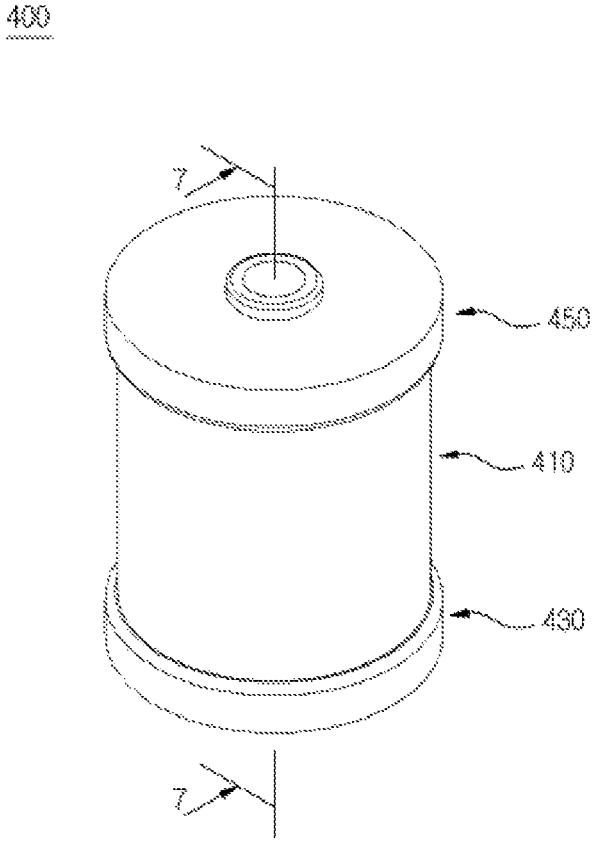

[FIG. 4]
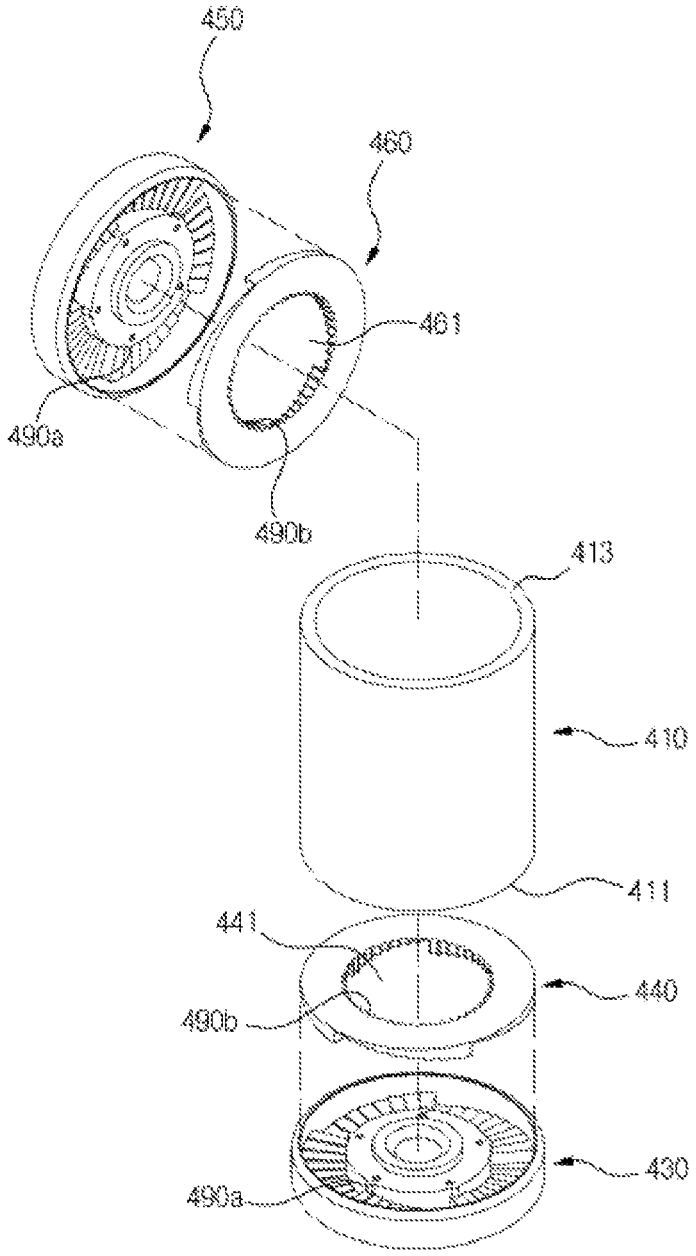

[FIG. 5]
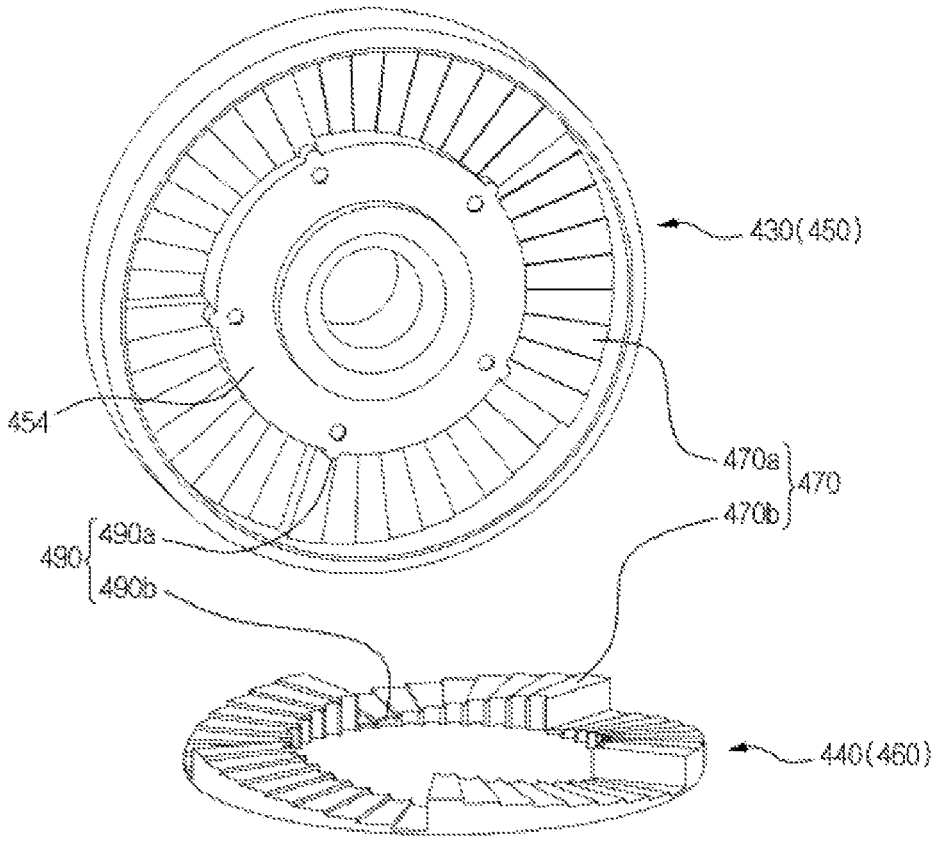

[FIG. 6]
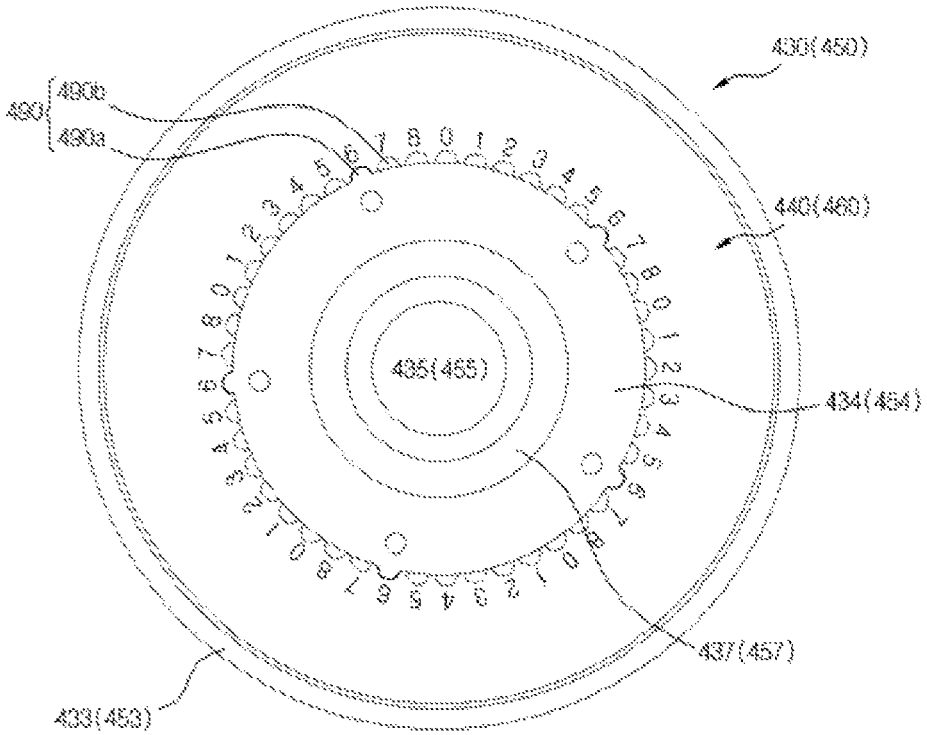

[FIG. 7]
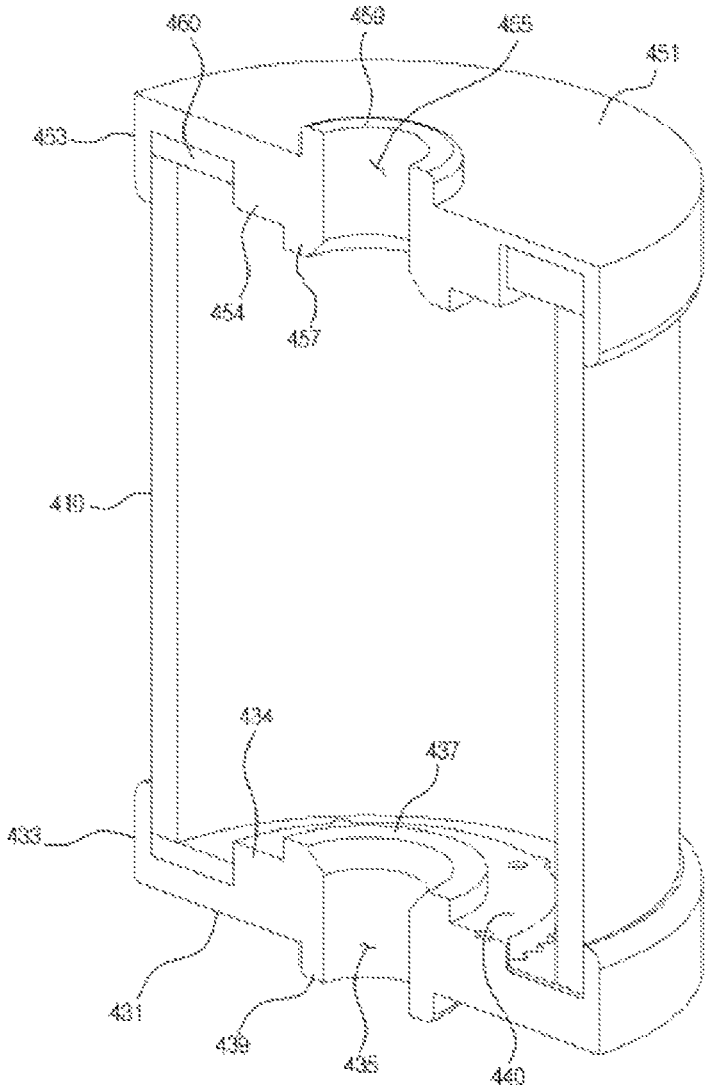

[FIG. 8]
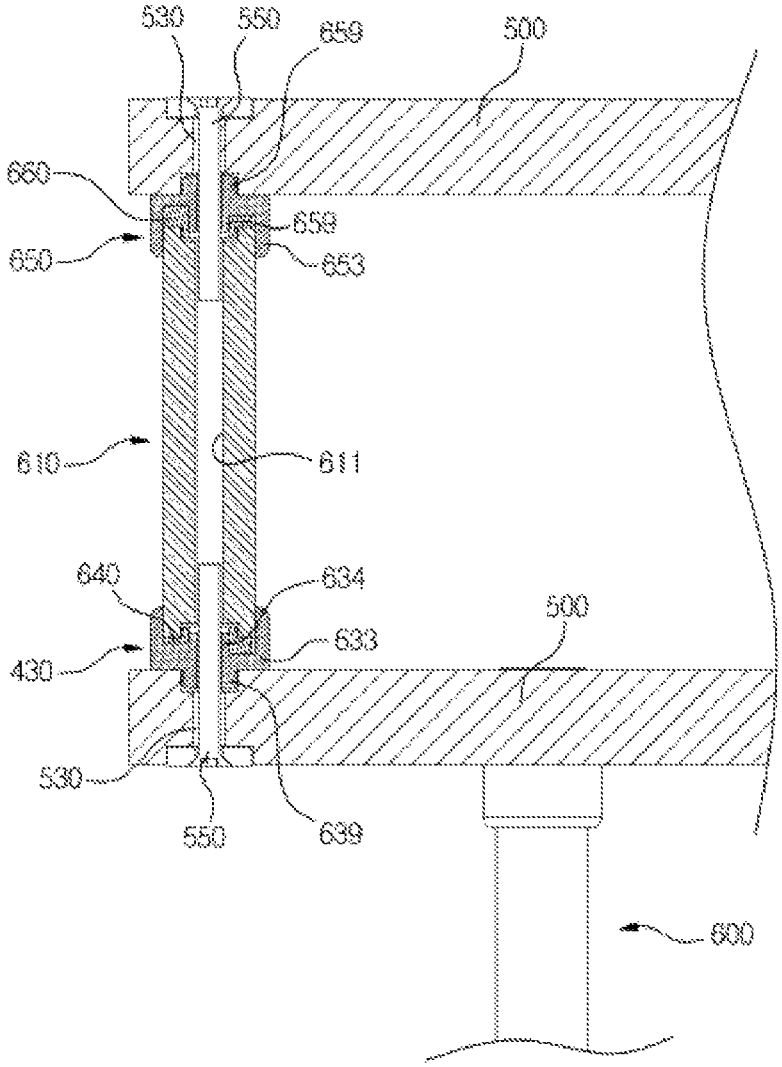

[FIG. 9]
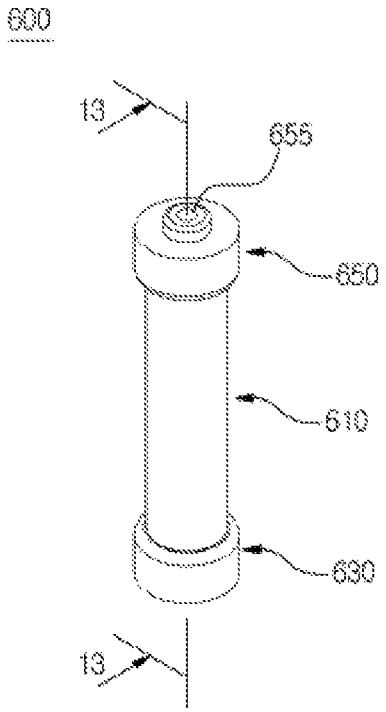

[FIG. 10]
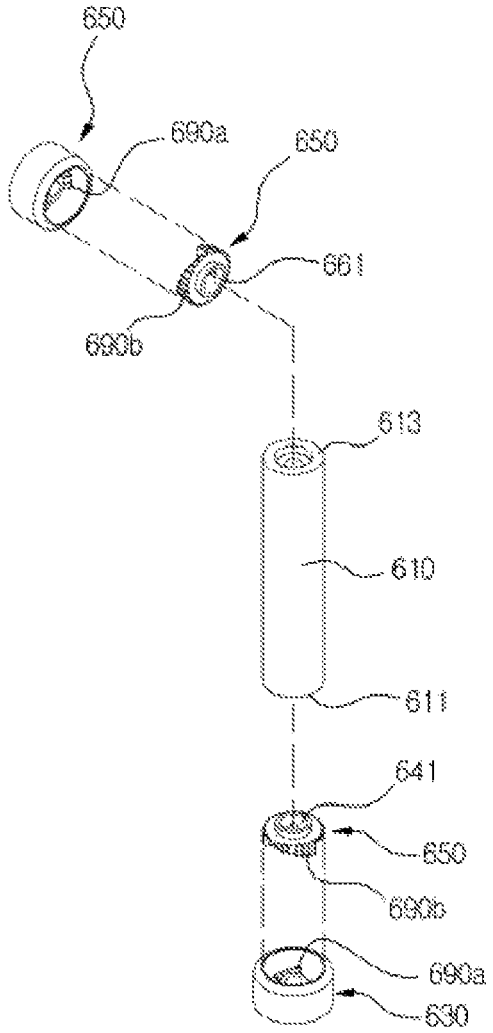

[FIG. 11]
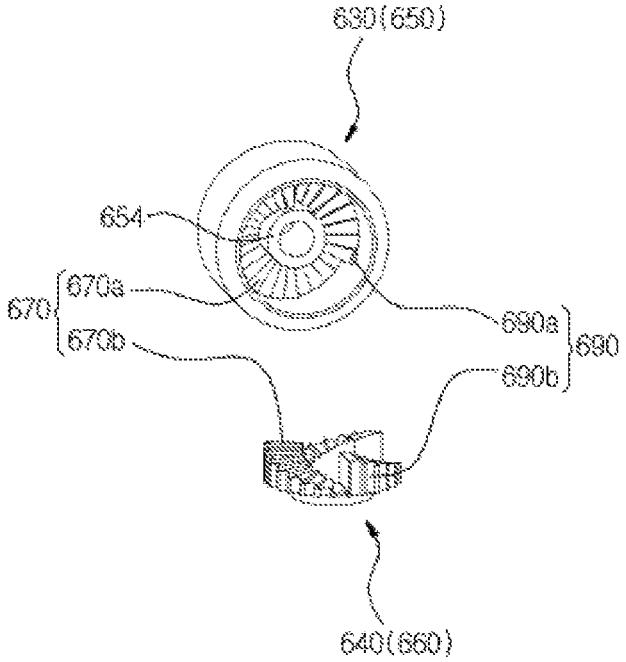
[FIG. 12]
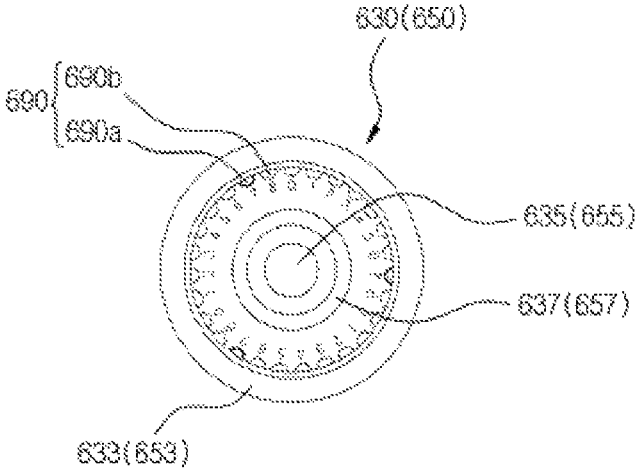

[FIG. 13]
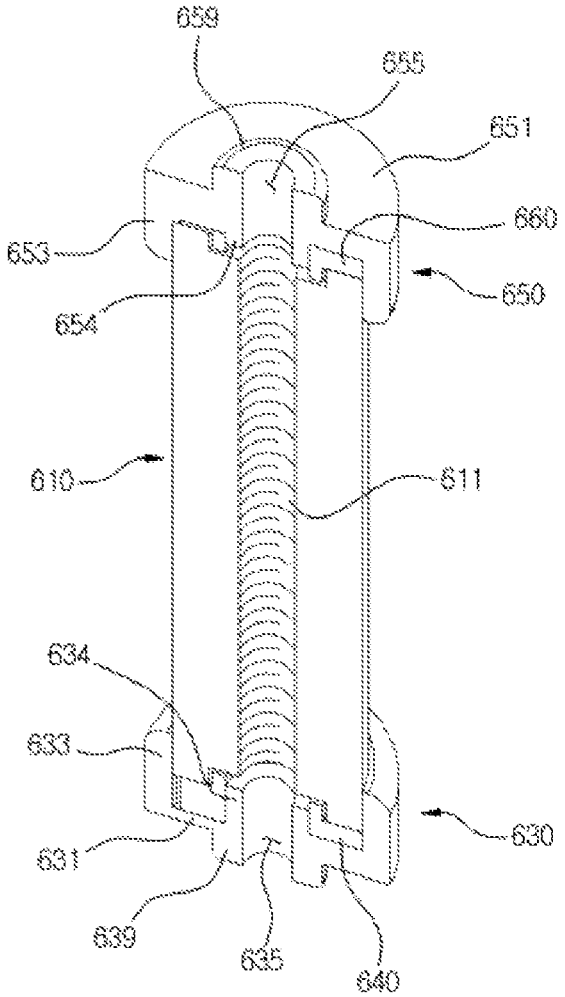

SPACER FOR PREFABRICATED SPIRAL STAIRCASE AND PREFABRICATED SPIRAL STAIRCASE USING SAME

TECHNICAL FIELD

The present invention relates to a spacer for a prefabricated spiral staircase and a prefabricated spiral staircase using the same which is capable of adjusting a height of the gaps between footboards for a prefabricated spiral staircase in multiple steps by using a minimum number of disks.

RELATED ART

A spiral staircase as a passage which has steps and connects two floor surfaces with different heights is considered an important factor in construction design.

Such a spiral staircase has a variety of forms. The most important thing in a spiral staircase is that a height of the gaps between footboards is equally divided such that the user feels comfortable. This is because a staircase having different heights of the gaps between footboards might cause the user to lose balance thereby leading to a serious accident.

The height between the first floor and the second floor in a building varies from place to place. There are many cases where the heights between the levels vary even in a building. As a result, when it comes to a spiral staircase, a carpenter needs to make a spiral staircase in the building where the spiral staircase will be installed by measuring the exact height between the levels of the building or needs to move a spiral staircase manufactured in a factory to the building to install the spiral staircase. As a means to solve such problems, provided is a prefabricated spiral staircase which enables an ordinary person to install the prefabricated spiral staircase.

The prefabricated spiral staircase is a standardized product for mass production and export, in which disk plates (spacers) for adjusting height are fitted into a cylindrical tube (main spacer) with a certain height at a desired height such that the height of the gap between footboards may be easily adjusted.

However, a plurality of disk plates are required for a conventional spiral staircase in some cases. Accordingly, the conventional spiral staircase is often used as a low-end staircase because the conventional spiral staircase is visually unpleasant due to the plurality of disk plates.

A cylindrical tube is customized depending on the place where the spiral staircase will be installed so as to avoid using the disk plates. This leads to an increase in the price of the spiral staircase.

Manufacturing such a customized spiral staircase is time and money consuming.

As a means to solve the above-described problems, devised is a spacer (see Korean Patent No. 10-1560676) whose design quality is upgraded by this applicant, in which disk plates for adjusting height are hidden by caps for covering up the upper and lower portions of the cylindrical tube such that the disk plates are not seen.

However, in the case of a prefabricated spiral staircase that has to be able to be installed in any places, a plurality of disk plates are indispensable.

In the case of a usual prefabricated spiral staircase, the height of the steps of standardized footboards is 210 mm, and such a staircase has generally 13 steps (210/13=16.15). Accordingly, 16 one-mm-thick disk plates are necessary for one step. This means a total of 208 one-mm-thick disk plates are needed (13×16=208).

If the disk plates (spacers) get thicker, fewer disk plates are used. However, height is not adjusted precisely. Additionally, if the disk plates (spacers) get thinner, height is adjusted precisely. However, more disk plates are used.

Depending on places, no disk plate (spacer) is used. However, in the case of a package-type prefabricated spiral staircase that has to be able to be installed at any height, a plurality of disk plates are indispensable (208 disk plates in the case of a one-mm-thick disk plate).

Due to this, a large number of disk plates (spacers) are wasted thereby leading to a waste of resources and an increase in costs. If all the disk plates are used, the spiral staircase becomes very heavy.

Three-to-four-mm-thick spacers are used for most conventional prefabricated spiral staircases. In this case, 65 to 52 spacers are needed. If the spacers get thicker, the height of footboards is not adjusted precisely.

Further, when many disk plates (spacers) are used, disk plates need to be counted such that height is adjusted thereby causing inconvenience to the user. For instance, if eight 1-mm-thick disk plates are used, it is difficult to count the disk plates with eyes. Accordingly, the disk plates need to be pulled out of the caps to check the exact number of the disk plates.

PRIOR ART DOCUMENT

Patent Document (Patent Document 1) Patent Document 1: Korean Laid-Open Patent Publication No. 10-2008-0108162

(Patent Document 2) Patent Document 2: Korean Patent No. 10-1560676

DETAILED DESCRIPTION OF THE INVENTION

Technical Problems

As a means to solve the above-described problems, the present invention is directed to providing spacers for a prefabricated spiral staircase and a prefabricated spiral staircase using the same which is capable of precisely adjusting a height of the gaps between footboards for a prefabricated spiral staircase by using a minimum number of disks so as to be installed in any place in a package type.

Technical Solutions

As a means to achieve the above-described purposes, a spacer for a prefabricated spiral staircase for adjusting a height between footboards according to the present invention includes cylindrical tubes; a lower cap or an upper cap fitted into the lower end or the upper end of the cylindrical tube; a disk positioned at the inside between the lower cap and the lower end of the cylindrical tube or at the inside between the upper cap and the upper end of the cylindrical tube; a height adjustment member adjusting a height between the upper cap and the disk or between the lower cap and the disk; a position determination member determining a position between the upper cap and the disk or between the lower cap and the disk, wherein the height adjustment member adjusts height depending on relative rotation between the upper cap and the disk or between the lower cap and the disk.

According to a spacer for a prefabricated spiral staircase of the present invention, height is adjusted from one step to two steps or from two steps to one step depending on relative rotation between the upper cap and the disk or between the lower cap and the disk.

According to a spacer for a prefabricated spiral staircase of the present invention, the lower cap or the upper cap consists of a horizontal plate which covers the lower end or the upper end of the cylindrical tube, and an outer vertical wall which protrudes from the edge of the horizontal plate in the upper direction or in the lower direction so as to be fitted into and wrap the outer side of the lower end of the cylindrical tube or the outer side of the upper end of the cylindrical tube, and the height adjustment member consists of a first multiple differentiated step part which is formed at the bottom of the horizontal plate and has multiple steps like a staircase, and a second multiple differentiated step part which is formed at the disk and corresponds to the first multiple differentiated step part.

According to a spacer for a prefabricated spiral staircase of the present invention, the first and second multiple differentiated step parts, preferably, are divided into at least three parts depending on the circumference so as to be arranged.

According to a spacer for a prefabricated spiral staircase of the present invention, the position determination member consists of position determination protrusions which are formed at the upper cap or the lower cap, and position determination grooves which are formed at the disk and coupled to the position determination protrusions, wherein the disk has numerical marks on the surface thereof according to heights of the second multiple differentiated step part, and the position determinations grooves are formed at every position where the numerical marks are formed.

A prefabricated spiral staircase according to the present invention includes a center pole whose lower end is supported by the floor, a plurality of footboards whose one side is fitted into the center pole, spacers for a center pole footboard which are fitted into the center pole and support the gap between the footboards, and spacers for an outside footboard which are fitted into the gap between the other sides of the footboards to support the same, wherein the spacers for a center pole footboard and the spacers for an outside footboard respectively include cylindrical tubes; a lower cap or an upper cap fitted into the lower side or the upper side of the cylindrical tube; disks positioned at the inside between the lower cap and the lower end of the cylindrical tube, or at the inside between the upper cap and the upper end of the cylindrical tube; a height adjustment member adjusting a height between the upper cap and the disk or between the lower cap and the disk; a position determination member determining a position between the upper cap and the disk or between the lower cap and the disk, wherein the height adjustment member adjusts height depending on relative rotation between the upper cap and the disk or between the lower cap and the disk.

According to a prefabricated spiral staircase of the present invention, height is adjusted from one step to two steps or from two steps to one step depending on relative rotation between the upper cap and the disk or between the lower cap and the disk.

According to a prefabricated spiral staircase of the present invention, the lower cap or the upper cap consists of a horizontal plate which covers the lower end of the cylindrical tube or the upper end of the cylindrical tube, and an outer vertical wall which protrudes from the edge of the horizontal plate in the upper direction or in the lower direction so as to be fitted into and wrap the outer side of the lower end of the cylindrical tube or the outer side of the upper end of the cylindrical tube, and the height adjustment member consists of a first multiple differentiated step part which is formed at the bottom of the horizontal plate and has multiple steps like a staircase, and a second multiple differentiated step part which is formed at the disk and corresponds to the first multiple differentiated step part, wherein the first and second multiple differentiated step parts are divided into at least three parts depending on the circumference so as to be arranged, the position determination member consists of position determination protrusions which are formed at the upper cap or the lower cap, and position determination grooves which are formed at the disk and coupled to the position determination protrusions, wherein the disk has numerical marks on the surface thereof according to heights of the second multiple differentiated step part, and the position determinations grooves are formed at every position where the numerical marks are formed.

Advantageous Effects

The effects of the present invention will be described as follows.

The present invention has the effects of adjusting height in multiple steps depending on relative rotation between the upper cap and the disk or between the lower cap and the disk, and of installing a prefabricated spiral staircase with high precision like a customized staircase by using a minimum number of disks because height may be adjusted with one disk, thereby improving the quality of the prefabricated spiral staircase.

In particular, the upper cap or the lower cap and the disks have multiple differentiated step parts that are corresponding to one another so as to adjust height. If height is not adjusted, the first and second multiple differentiated step parts corresponding to one another contact one another such that the entire circumference is supported. The present invention has a useful layout configured to withstand pressing force exerted onto footboards because parts where the first, second multiple differentiated step parts contact one another are gradually reduced when the height gets greater and greater (for instance, when the height is adjusted to the greatest level, one in the upper portion and one in the lower portion, out of the first, second multiple differentiated step parts, contact each other).

Further, at the time of adjusting height, parts where the first and second multiple differentiated step parts contact one another are widened, while a compressive load is equally distributed because the first and second multiple differentiated step parts are divided into at least three parts depending on the circumference so as to be arranged such that the user steps on the footboards in a stable manner without being tilted to one side.

Further, the position determination grooves of the disks, which are coupled to the position determination protrusions of the upper cap or the lower cap, also serve as places for a tool such that a tool etc. is fitted into the position determination groove to lift the disk when the disk put on the upper surface of the lower cap is rotated.

For instance, when the position of the disk is changed in the state where the spacer is fitted into the center pole, the lower cap is pulled out of the center pole and then fitted into the center pole again because the lower cap may not be overturned. Accordingly, the position determination groove serving as a place for a tool is very useful in building a fabricated spiral staircase.

Further, when the disks are fitted into the grooves at a desired numerical mark, height is adjusted to a desired level.

In this case, the disks do not need to be counted, or height does not need to be measured with a ruler to check the height. The user can check the height only by seeing the numbers with eyes. Accordingly, a spacer for a prefabricated spiral staircase of the present invention may be easily installed because an intuitive interface is possible.

BRIEF DESCRIPTION OF THE DRAWINGS

FIG. 1 is a perspective view illustrating a prefabricated spiral staircase using a spacer according to a preferred embodiment of the present invention.

FIG. 2 is a sectional view illustrating a section cut along the line 2-2 in FIG. 1.

FIG. 3 is a perspective view illustrating the appearance of the spacer for center pole footboards in FIG. 1.

FIG. 4 is an exploded perspective view of FIG. 3.

FIG. 5 is a perspective view illustrating first, second multiple differentiated steps between the upper cap (or lower cap) and the disk in FIG. 4.

FIG. 6 is a plan view illustrating a state where a disk is accommodated in the upper cap (or lower cap) in FIG. 5.

FIG. 7 is a cross sectional perspective view illustrating a section cut along the line 7-7 in FIG. 3.

FIG. 8 is a sectional view illustrating a section cut along the line 8-8 in FIG. 1.

FIG. 9 is a perspective view illustrating the appearance of the spacer for outside footboards in FIG. 1.

FIG. 10 is an exploded perspective view in FIG. 9.

FIG. 11 is a perspective view illustrating first, second multiple differentiated steps between the upper cap (or lower cap) and the disk in FIG. 10.

FIG. 12 is a plan view illustrating a state where a disk is accommodated in the upper cap (or lower cap) in FIG. 11.

FIG. 13 is a cross sectional perspective view illustrating a section cut along the line 13-13 in FIG. 9.

MODE FOR CARRYING OUT THE INVENTION

Below, preferred embodiments of the present invention will be described with reference to the attached drawings.

FIG. 1 is a perspective view illustrating a prefabricated spiral staircase using a spacer according to a preferred embodiment of the present invention, FIG. 2 is a sectional view illustrating a section cut along the line 2-2 in FIG. 1, FIG. 3 is a perspective view illustrating the appearance of the spacer for center pole footboards in FIG. 1, FIG. 4 is an exploded perspective view of FIG. 3, FIG. 5 is a perspective view illustrating first, second multiple differentiated steps between the upper cap (or lower cap) and the disk in FIG. 4, FIG. 6 is a plan view illustrating a state where a disk is accommodated in the upper cap (or lower cap) in FIG. 5, FIG. 7 is a cross sectional perspective view illustrating a section cut along the line 7-7 in FIG. 3, FIG. is a sectional view illustrating a section cut along the line 8-8 in FIG. 1, FIG. 9 is a perspective view illustrating the appearance of the spacer for outside footboards in FIG. 1, FIG. 10 is an exploded perspective view in FIG. 9, FIG. 11 is a perspective view illustrating first, second multiple differentiated steps between the upper cap (or lower cap) and the disk in FIG. 10, FIG. 12 is a plan view illustrating a state where a disk is accommodated in the upper cap (or lower cap) in FIG. 11, and FIG. 13 is a cross sectional perspective view illustrating a section cut along the line 13-13 in FIG. 9.

With reference to FIGS. 1 and 2, a prefabricated spiral staircase 100 according to a preferred embodiment of the present invention includes a base 200 fixed to the floor, a center pole 300 whose lower end is installed at the base 200, a plurality of footboards 500 whose one side is fitted into the center pole 300, spacers 400 for a center pole footboard which are fitted into the center pole 300 and positioned between footboards 500 to support the same, and spacers 600 for an outside footboard which are positioned between the other sides of the footboards to support the same.

The base 200 has a circular plate shape fixed to the floor and has a female screw hole at the center thereof to which the lower end of the center pole 300 is coupled. Further, a usual rod or a male screw rod may be used as the center pole 300. In the case of a male screw rod used as the center pole 300 as in this embodiment, the male screw rod is coupled to the female screw hole of the base 200 until the lower end of the center pole 300 touches the floor and is caught on the floor (see FIG. 15 in Patent Document 2).

The height of the center pole 300 is adjustable according to the height between stories by connecting the center poles 300 with each other.

That is, a center pole 300 and a center pole 300 used as a male screw rod are coupled by means of a connection nut so as to increase the height of the center pole 300.

A spacer 400 for a center pole footboard, as illustrated in FIGS. 3 to 7, consists of a cylindrical tube 410 which forms the shape of the spacer for a center pole footboard, and a lower cap 430 and an upper cap 450 which are fitted into the lower side and upper side of the cylindrical tube 410.

The cylindrical tube 410 has a circular cylinder shape and preferably, has a height slightly smaller than that between usual footboards 550. This is useful to adjust height at the time of installation.

The lower cap 430 and the upper cap 450 consist of a horizontal plate 431, 451 which covers the upper and lower surfaces of the cylindrical tube 410, and an outer vertical wall 433, 453 which protrudes from the edge of the horizontal plate 431, 451 so as to be fitted into the outer surface of the cylindrical tube 410. To be sure, a through hole 435, 455 which is fitted into the center pole 300 is formed at the center of the horizontal plate 431, 451.

Accordingly, when the lower cap 430 is fitted into the cylindrical tube 410, the height of the cylindrical tube increases as much as the thickness of the horizontal plate 431 of the lower cap 430, and when the lower cap 430 and the upper cap 450 are fitted into the cylindrical tube 410, the thickness is doubled.

In particular, the spacer 400 for a center pole footboard further includes upper and lower disks 460, 440, upper and lower caps 450, 430, a height adjustment member 470 for adjusting heights of the upper and lower disks 460, 440, and a position determination member 490 for determining a position between the upper and lower caps 450, 430 and the upper and lower disks 460, 440.

That is, the upper and lower disks 460, 440 play a role of the first height adjustment thickness (thickness corresponding to numerical mark 0 in this embodiment) and are inserted into the inside between the lower cap 430 and the lower end 411 of the cylindrical tube 410 or into the inside between the upper cap 450 and the upper end 413 of the cylindrical tube 410 so as to finely adjust a height of the gap between the footboard 500.

The upper and lower disks 460, 440 have a thin doughnut shape, and a through hole 461, 441 which is formed at the center of the upper and lower disks such that the center pole 300 penetrates.

Meanwhile, preferably, an inner vertical wall 434, 454 and a nut position surface 437, 457 which extend inwards on the basis of the through hole 435, 455 of the horizontal plate 431, 451 are further included as illustrated in FIGS. 2 and 7.

An accommodation groove on which the disk 460, 440 are put is formed between the inner vertical wall 434, 454 and the outer vertical wall 433, 453.

Preferably, the nut position surface 437, 457 is tightened by means of a pressure nut 700 so as to prevent the nut position surface from being shaken after the lower cap 430 is fitted if a male screw rod is used as the center pole 300.

To be sure, if a usual rod is used as the center pole 300, the nut position surface 437, 457 are not necessary because the uppermost end of the rod may be tightened by means of a final nut or bolt so as to support footboards in a stable manner.

Further, preferably, a protrusion 439, 459 that extends outwards, as illustrated in FIGS. 2 and 7, is further formed on the basis of the through hole 435, 455 of the horizontal plate 431, 451.

The protrusion 439, 459 is fitted into a through hole 510 formed at one side (or the center) of the footboard 500.

The height adjustment member 470 may be configured to adjust height depending on relative rotation between the upper cap 450 and the disk 460 or the lower cap 430 and the disk 440.

That is, height is adjusted from one step to two steps or from two steps to one step depending on relative rotation between the upper cap 450 and the disk 460 or the lower cap 430 and the disk 440.

As an example of an adjustment in height depending on such relative rotation, first, second multiple differentiated step parts 470A, 470B corresponding to each other are implemented in this embodiment.

The height adjustment member 470 consists of a first multiple differentiated step part 470A which is formed at the bottom of the horizontal plate 431 or 451 and has multiple steps like a staircase, and a second multiple differentiated step part 470B which is formed at one surface of the disk 440 or 460 and corresponds to the first multiple differentiated step part 470A.

As described above, height is finely adjustable depending on which ones out of the first 470A and second 470B multiple differentiated step parts contact each other. Accordingly, height may be adjusted as finely as possible with a minimum number of disks 440, 460.

Further, height reaches the highest level (numerical mark 8) when only one of the first multiple differentiated step part 470A and only one of the second multiple differentiated step part 470B contact each other.

Accordingly, if one number of the numerical marks of 0 to 8 denotes 1 mm, a total height of 8 mm may be adjusted with one disk.

Further, the disk 440 or 460 has numerical marks such that adjusted heights may be checked readily and rapidly.

Such first 470A and second 470B multiple differentiated step parts, preferably, are divided into at least three parts (a sector at the interval of 120°) depending on the circumference so as to be arranged, and more preferably, are divided into five parts as in the embodiment so as to be arranged.

A compressive load is almost equally distributed when the disk is divided in many parts and the size of a contacted surface remains the same. Accordingly, footboards may be supported in a stable manner and may not be tilted to one side because of balance of force.

The number of divided sectors may be determined depending on the diameter. For instance, the multiple differentiated step part of the spacer 400 for a center pole footboard is divided into five parts, and the multiple step part of the spacer 600 for an outside footboard is divided into three parts because the spacer 400 for a center pole footboard has a diameter larger than that of the spacer 600 for an outside footboard.

According to this embodiment described above, the present invention has a layout in which upper and lower caps 450, 430, and a minimum number of upper and lower disks 460, 440 as well are assembled or disassembled such that heights of a spacer 400 for a center pole footboard may be finely adjusted, and force is equally distributed so as to allow the user to step on the footboards in a stable manner by adjusting the height of the gaps between footboards 500 despite differences in heights between stories in places where prefabricated spiral staircases will be installed.

Accordingly, a prefabricated spiral staircase may be installed rapidly and readily in any place by using the spacer 400 for a center pole footboard according to this embodiment without manufacturing or processing a separate part for adjusting height.

Meanwhile, the position determination member 490, as illustrated in FIGS. 5 and 6, consists of position determination protrusions 490A which are formed at the upper cap 450 or the lower cap 430, and position determination grooves 490B which are formed at the disk 440 or 460 and coupled to the position determination protrusions 490A.

The position determination protrusions 490A are formed to protrude in the shape of a half cylinder on the outer surface of the inner vertical wall 434 or 451 at predetermined intervals.

The position determination grooves 490B are dug inwards and formed at positions corresponding to each of the differentiated steps of the inner side of the hollow hole of the disk 440 or 460.

Among the position determination grooves 490B, position determination grooves 490B that are not coupled to the position determination protrusions 490A provide a space so as to be hung and lifted by means of a tool.

That is, the lower cap 430 coupled with the disk 440 is fitted into the center pole 300 such that height is adjusted, and when the disk 440 is rotated to be adjusted again, the uncoupled position determination grooves 490B provide a space for a tool to lift the disk without pulling the lower cap 430 out of the center pole 300, thereby making it easier to build a prefabricated spiral staircase.

Like the spacer 400 for a center pole footboard, the spacer 600 for an outside footboard, as illustrated in FIGS. 8 to 13, consists of a cylindrical tube 610 which forms the shape of the spacer for an outside footboard, and a lower cap 630 and an upper cap 650 which are fitted into the lower side and upper side of the cylindrical tube 610.

The cylindrical tube 610 also has a cylinder shape but has a diameter smaller than that of the cylindrical tube 410. Accordingly, the cylindrical tube 610 becomes large in width so as to increase support force.

Further, the inner circumferential surface of the cylindrical tube 610 has a female screw 611 coupled and supported by a bolt 550. Accordingly, the female screw 611, preferably, has a small inner diameter.

Further, the lower cap 630 and the upper cap 650 consist of a horizontal plate 631, 651 which covers the upper and lower surfaces of the cylindrical tube 610, and an outer vertical wall 633, 653 which protrudes from the edge of the horizontal plate 631, 651 so as to be fitted into the outer surface of the cylindrical tube 610. To be sure, a through hole 635, 655 which is penetrated by the bolt 550 is formed at the center of the horizontal plate 631, 651.

Accordingly, when the lower cap 630 is fitted into the cylindrical tube 610, the height of the cylindrical tube increases as much as the thickness of the horizontal plate 631 of the lower cap 630, and when the lower cap 630 and the upper cap 650 are fitted into the cylindrical tube 610, the thickness is doubled.

Further, the spacer 600 for an outside footboard further includes a height adjustment member 670 for adjusting heights of the upper and lower disks 660, 640, and the upper and lower caps 650, 630 and the upper and lower disks 660, 640, and further includes a position determination member 690 for determining a position between the upper and lower caps 650, 630 and the upper and lower disks 660, 640 such that the height of the spacer 600 for an outside footboard corresponds to the height of the spacer 400 for a center pole footboard.

That is, the upper and lower disks 660, 640 also play a role of the first height adjustment thickness (thickness corresponding to numerical mark 0 in this embodiment) and are inserted into the inside between the lower cap 630 and the lower end 611 of the cylindrical tube 610 or into the inside between the upper cap 650 and the upper end 613 of the cylindrical tube 610 so as to finely adjust the height of the other end space between the footboard 500 and the footboards 500.

The upper and lower disks 660, 640 also have a thin doughnut shape, and a through hole 661, 641 which is formed at the center of the upper and lower disks and is penetrated by the bolt 550.

Further, preferably, an inner vertical wall 634, 654 which extends inwards on the basis of the through hole 635, 655 of the horizontal plate 631, 651 is further included as illustrated in FIG. 13.

An accommodation groove on which the disk 660, 640 are put is formed between the inner vertical wall 634, 654 and the outer vertical wall 633, 653.

Further, preferably, a protrusion 639, 659 that extends outwards on the basis of the through hole 635, 655 of the horizontal plate 631, 651 is further included as illustrated in FIGS. 8 and 13.

The protrusion 639, 659 is fitted into a through hole 530 formed at the other side (or outside) of the footboard 500.

The height adjustment member 670 may be configured to adjust height depending on relative rotation between the upper cap 650 and the disk 660, or the lower cap 630 and the disk 640.

That is, height is adjusted from one step to two steps or from two steps to one step depending on relative rotation between the upper cap 650 and the disk 660, or the lower cap 630 and the disk 640.

As an example of an adjustment in height depending on such relative rotation, first, second multiple step parts 670A, 670B that are corresponding to each other are implemented in this embodiment.

Like the height adjustment member 470, the height adjustment member 670 consists of a first multiple differentiated step part 670A which is formed at the bottom of the horizontal plate 631 or 651 and has multiple steps like a staircase, and a second multiple differentiated step part 670B which is formed at one surface of the disk 640 or 660 and corresponds to the first multiple differentiated step part 670A.

As described above, height is finely adjustable depending on which ones out of the first 670A and second 670B multiple differentiated step parts contact each other. Accordingly, height may be adjusted as finely as possible with a minimum number of disks 640, 660.

Further, height reaches the highest level (numerical mark 8) when only one of the first multiple differentiated step part 670A and only one of the second multiple differentiated step part 670B contact each other.

Accordingly, if one number of the numerical marks of 0 to 8 denotes 1 mm, a total height of 8 mm may be adjusted with one disk.

Further, the disk 640 or 660 has numerical marks such that adjusted heights may be checked readily and rapidly.

Such first 670A and second 670B multiple step parts, preferably, are divided into at least three parts (a sector at the interval of 120°) depending on the circumference so as to be arranged, and more preferably, are divided into three parts as in the embodiment so as to be arranged.

A compressive load is almost equally distributed when the disk is divided in many parts and the size of a contacted surface remains the same. Accordingly, footboards may be supported in a stable manner and my not be tilted to one side because of balance of force.

The number of divided sectors may be determined depending on the diameter. For instance, the multiple differentiated step part of the spacer 400 for a center pole footboard is divided into five parts, and the multiple differentiated step part of the spacer 600 for an outside footboard is divided into three parts because the spacer 600 for an outside footboard has a diameter smaller than that of the spacer 400 for a center pole footboard.

According to this embodiment described above, the present invention has a layout in which upper and lower caps 650, 630, and a minimum number of upper and lower disks 660, 640 as well are assembled or disassembled such that heights of a spacer 400 for a center pole footboard may be finely adjusted, and force is equally distributed so as to allow the user to step on the footboards in a stable manner by adjusting the height of the gap between footboards 500 despite differences in heights between stories in places where prefabricated spiral staircases will be installed.

Accordingly, a prefabricated spiral staircase may be installed rapidly and readily in any place by using the spacer 400 for a center pole footboard and the spacer 600 for an outside footboard according to this embodiment without manufacturing or processing a separate part for adjusting height.

Meanwhile, the position determination member 690, as illustrated in FIGS. 11 and 12, consists of position determination protrusions 690A which are formed at the upper cap 650 or the lower cap 630, and position determination grooves 690B which are formed at the disk 640 or 660 and coupled to the position determination protrusions 490 A.

The position determination protrusions 690A are formed to protrude in the shape of a half cylinder on the outer surface of the inner vertical wall 636 or 635 at predetermined intervals.

The position determination grooves 690B are dug inwards and formed at positions corresponding to each of the steps of the outer side of the hollow hole of the disk 640 or 660.

Among the position determination grooves 690B, position determination grooves 690B that are not coupled to the position determination protrusions 690A provide a space for a tool to fit in and lift.

The present invention has been described with reference to the preferred embodiment. However, it should be understood that one skilled in the art to which the present invention pertains may modify and change the present invention in various forms without departing from the spirit and scope of the present invention set forth in the appended claims.

INDEX OF REFERENCE NUMBERS

100: Prefabricated spiral staircase
200: Base
300: Center pole
400, 600: Spacer
410, 610: Cylindrical tube
450, 430; 650, 630: Upper and lower caps
460, 440; 660, 640: Upper and lower disks
470, 670: Height adjustment member
470A, 470B; 670A, 670: First, second multiple differentiated step part
490, 690: Position determination member
490A, 690A: Position determination protrusion
490B, 690B: Position determination groove
500: Footboard

The invention claimed is:

1. A spacer for a prefabricated spiral staircase for adjusting a height between footboards comprising:

a cylindrical tube;

a cap fitted into an end of the cylindrical tube;

a disk positioned at an inside between the cap and the cylindrical tube;

a height adjustment member adjusting a height between the cap and the disk;

a position determination member determining a position between the cap and the disk;

wherein the height adjustment member adjusts height depending on relative rotation between the cap and the disk;

the cap comprises a horizontal plate which covers an end of the cylindrical tube, and an outer vertical wall which protrudes from an edge of the horizontal plate so as to be fitted into and wrap an outer side of the end of the cylindrical tube;

the height adjustment member comprises a first multiple differentiated step part which is formed at a bottom of the horizontal plate and has multiple steps, and a second multiple differentiated step part which is formed at the disk and corresponds to the first multiple differentiated step part;

the position determination member comprises position determination protrusions which are formed at the cap, and position determination grooves which are formed at the disk and coupled to the position determination protrusions;

the disk has numerical marks on a surface thereof according to heights of the second multiple differentiated step part; and the position determination grooves are formed at every position where the numerical marks are formed.

2. A prefabricated spiral staircase comprising:

a center pole whose lower end is supported by a floor;

a plurality of footboards whose one side is fitted into the center pole;

spacers for a center pole footboard which are fitted into the center pole and support gaps between the footboards;

spacers for an outside footboard which are fitted into the gaps between another side of the footboards to support the another side of the footboards;

wherein the spacers for a center pole footboard and the spacers for an outside footboard respectively comprise a cylindrical tube, a cap fitted into an end of the cylindrical tube, disks positioned at an inside between the cap and the cylindrical tube, a height adjustment member adjusting a height between the cap and the disk, and a position determination member determining a position between the cap and the disk;

the height adjustment member adjusts height depending on relative rotation between the cap and the disk;

the cap comprises a horizontal plate which covers the end of the cylindrical tube, and an outer vertical wall which protrudes from an edge of the horizontal so as to be fitted into and wrap an outer side of the cylindrical tube;

the height adjustment member comprises a first multiple differentiated step part which is formed at a bottom of the horizontal plate and has multiple steps, and a second multiple differentiated step part which is formed at the disk and corresponds to the first multiple differentiated step part;

the position determination member comprises position determination protrusions which are formed at the cap, and position determination grooves which are formed at the disk and coupled to the position determination protrusions;

the disk has numerical marks on a surface thereof according to heights of the second multiple differentiated step part; and the position determination grooves are formed at every position where the numerical marks are formed.

* * * * *